US007894963B2

(12) United States Patent
Shenoy et al.

(10) Patent No.: US 7,894,963 B2
(45) Date of Patent: Feb. 22, 2011

(54) SYSTEM AND METHOD FOR CONTROLLING A MACHINE

(75) Inventors: Anil Shenoy, Raleigh, NC (US); John R. Connolly, Clayton, NC (US)

(73) Assignee: Caterpillar Inc., Peoria, IL (US)

( * ) Notice: Subject to any disclaimer, the term of this patent is extended or adjusted under 35 U.S.C. 154(b) by 378 days.

(21) Appl. No.: 11/947,912

(22) Filed: Nov. 30, 2007

(65) Prior Publication Data

US 2008/0154466 A1 Jun. 26, 2008

Related U.S. Application Data

(60) Provisional application No. 60/876,728, filed on Dec. 21, 2006.

(51) Int. Cl.

| | |
|---|---|
| ***G06F 7/70*** | (2006.01) |
| ***G06F 19/00*** | (2006.01) |
| ***G06G 7/00*** | (2006.01) |
| ***G06G 7/76*** | (2006.01) |

(52) U.S. Cl. ..... 701/50; 180/242

(58) Field of Classification Search ..... 701/36, 701/50; 180/242

See application file for complete search history.

(56) References Cited

U.S. PATENT DOCUMENTS

| | | | | |
|---|---|---|---|---|
| 4,704,922 | A * | 11/1987 | Suketomo et al. | 475/64 |
| 4,951,462 | A * | 8/1990 | Graf | 60/444 |
| 5,553,517 | A * | 9/1996 | Yesel et al. | 74/731.1 |
| 5,564,507 | A * | 10/1996 | Matsushita et al. | 172/3 |
| 5,844,800 | A * | 12/1998 | Brandt et al. | 700/97 |
| 6,010,309 | A | 1/2000 | Takamura et al. | |
| 6,321,866 | B1 * | 11/2001 | Prohaska | 180/307 |
| 6,385,519 | B2 | 5/2002 | Rocke | |
| 6,427,107 | B1 | 7/2002 | Chiu et al. | |
| 6,595,885 | B1 | 7/2003 | Lutgen | |
| 6,609,368 | B2 | 8/2003 | Dvorak et al. | |
| 6,675,577 | B2 | 1/2004 | Evans | |
| 6,694,240 | B1 | 2/2004 | Swick et al. | |
| 7,114,433 | B2 | 10/2006 | Shenoy et al. | |
| 2005/0071068 | A1 * | 3/2005 | Funato et al. | 701/54 |
| 2006/0042241 | A1 | 3/2006 | Bright et al. | |
| 2006/0069484 | A1 | 3/2006 | Thomson et al. | |
| 2007/0119161 | A1 | 5/2007 | Du et al. | |

OTHER PUBLICATIONS

Komatsu Backhoe Loaders Brochure [online], (retrieved on Aug. 10, 2006) Retrieved from the Komatsu website using Internet <URL: http://www.komatsu.com>.

* cited by examiner

*Primary Examiner*—Jack Keith
*Assistant Examiner*—Rami Khatib
(74) *Attorney, Agent, or Firm*—William A. Beckman

(57) ABSTRACT

A machine is provided. The machine includes an engine, an engine speed sensor, a transmission, a transmission status sensor, a pump, and a controller. The engine speed sensor is configured to sense the speed of the engine. The transmission is coupled to the engine. The transmission status sensor is configured to sense the status of the transmission. The pump is coupled to the engine and has a first torque mode and a second torque mode. The controller is in communication with the engine speed sensor and the transmission status sensor and is operable to automatically switch the pump from the first torque mode to the second torque mode based on the engine speed and the transmission status.

13 Claims, 4 Drawing Sheets

SYSTEM AND METHOD FOR CONTROLLING A MACHINE

CLAIM FOR PRIORITY

The present application claims priority from U.S. Provisional Application Ser. No. 60/876,728, filed Dec. 21, 2006, which is fully incorporated herein.

TECHNICAL FIELD

The present disclosure relates generally to a system and method for controlling a machine, and more particularly, to a system and method for controlling a hydraulic pump for a machine.

BACKGROUND

Machines having one or more hydraulically controlled implements in addition to a powertrain must balance available engine power between the powertrain and the hydraulics. Backhoe loaders, for example, typically have a loader at one end of the machine and a digging implement or backhoe at the other end. Hydraulic cylinders actuate these implements. The engine powers a hydraulic pump that supplies hydraulic pressure to the hydraulic cylinders. In order to increase available pump torque, an operator may increase the engine speed by moving a throttle, such as a hand controller or a foot pedal, from a throttle setting corresponding with a low idle engine speed to a throttle setting corresponding with an increased engine speed. When operating the backhoe while the work machine is stationary, almost all of the engine power is available in order to power the hydraulic pump. In contrast, because an operator will also drive while operating the loader, engine power must be balanced between the hydraulic pump and the powertrain.

Techniques have been developed that seek to optimize engine power, machine speed, sensitivity, and fuel economy. For example, backhoe loaders have been developed that have a manually actuated button that switches a pump from a power mode for increased power and speed to an economy mode for fine control and increased fuel efficiency. This manually selectable, dual-range pump allows an operator some degree of control; however, manually switching between the economy mode and the power mode optimally may be problematic. While operating the machine, an operator must simultaneously monitor multiple variables such as the current pump mode, the engine speed, the transmission status, and the active implement. Novice operators may have difficulty efficiently switching between modes. Efficiently switching between modes when the machine is moving, for example while operating the loader, may prove even more problematic.

The present disclosure is directed to overcome one or more of the problems as set forth above.

SUMMARY OF THE INVENTION

In one aspect of the present disclosure, a machine is provided. The machine includes an engine, an engine speed sensor, a transmission, a transmission status sensor, a pump, and a controller. The engine speed sensor is configured to sense the speed of the engine. The transmission is coupled to the engine. The transmission status sensor is configured to sense the status of the transmission. The pump is coupled to the engine and has a first torque mode and a second torque mode. The controller is in communication with the engine speed sensor and the transmission status sensor and is operable to automatically switch the pump from the first torque mode to the second torque mode based on the engine speed and the transmission status.

In another aspect of the present disclosure, a method of controlling a machine is provided. The machine includes an engine coupled to a pump and a transmission, with the pump having a first torque mode and a second torque mode. The method includes the step of measuring the engine speed. The method also includes the step of sensing the transmission status. The method also includes the step of switching the pump from the first torque mode to the second torque mode based on the engine speed and the transmission status.

A third aspect of the present disclosure includes a method of controlling a backhoe loader. The backhoe loader has an engine coupled to a pump and a transmission, with the pump having a first torque mode and a second torque mode. The method includes the steps of sensing the transmission status and setting a controller to one of a backhoe mode or a loader mode based on the transmission status. The method also includes the step of measuring the engine speed. The method also includes the step of switching the pump from the first torque mode to the second torque mode when the engine speed exceeds a first set point and when the controller is in the loader mode. The method also includes the step of switching the pump from the first torque mode to the second torque mode when the engine speed exceeds a second set point and when the controller is in the backhoe mode.

DETAILED DESCRIPTION

Figure 1:
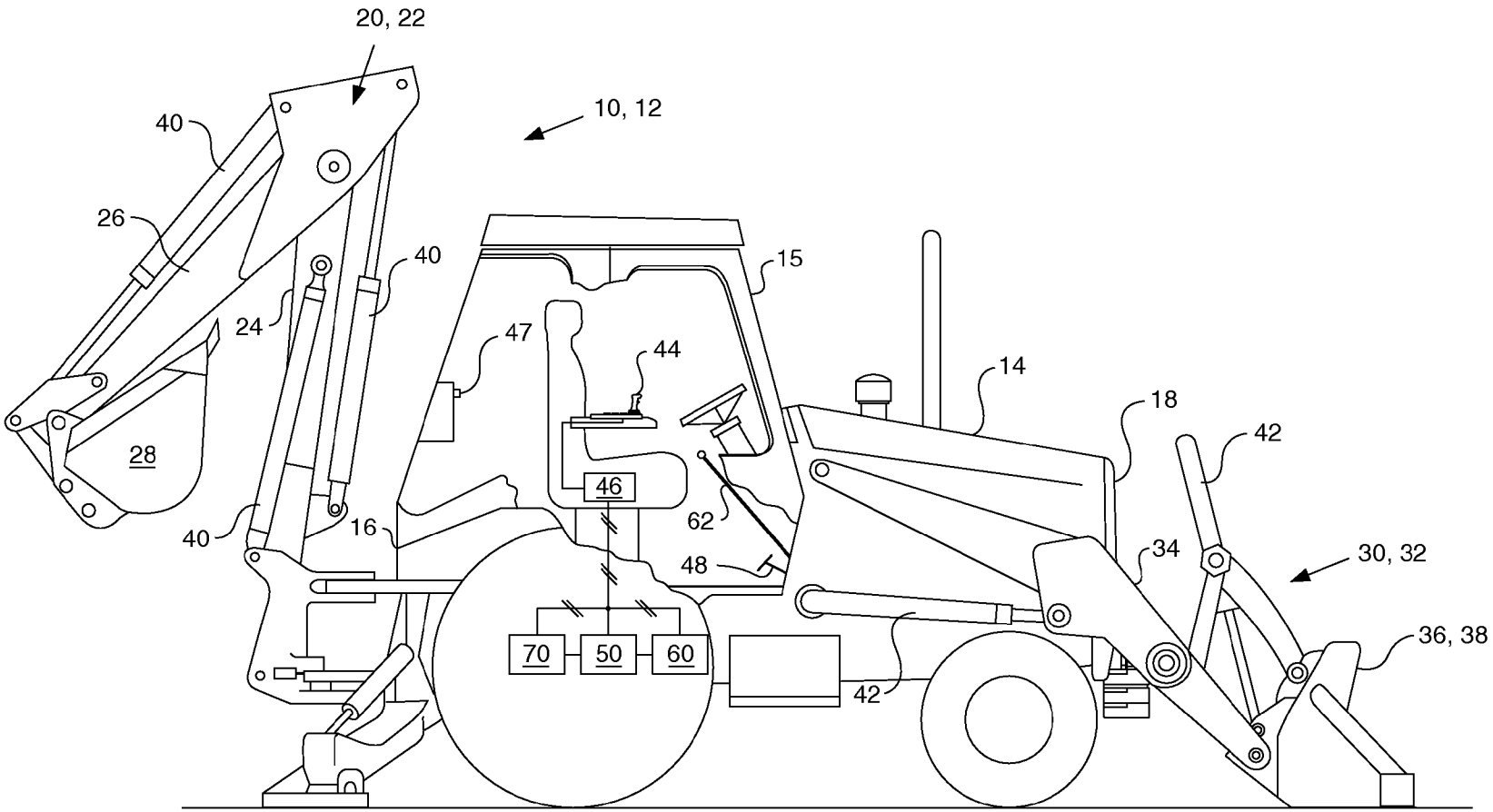
FIG. 1 is a drawing of an exemplary machine suitable for use with the present disclosure.

FIG. 1 illustrates a machine 10, which in the illustrated example is a backhoe loader 12, but may also be any other machine having an implement. As shown, the machine 10 includes a body 14 having an operator station or cab 15. Attached to a rear side 16 of the body 14 is a first implement 20, shown as a backhoe 22 that is generally used for stationary digging. Attached to a front side 18 of the body 14 is preferably a second implement 30, shown as a loader 32 that is generally used for shoveling. The backhoe 22 includes a boom 24 pivotally coupled to the body 14, a stick 26 pivotally coupled to the boom 24, and a bucket 28 pivotally coupled to the stick 26. The loader 32 includes a pair of arms 34 (only one shown) movably attached to the front side 18 of the body 14. The pair of arms 34 can be moved upward and downward in order to lift and lower a material engaging member 36, shown as a loader bucket 38. The loader bucket 38 is moveably attached to the pair of arms 34 and can be raised and lowered about a horizontal axis. While the first and second implements 20, 30 are illustrated as a backhoe 22 and a loader 32, respectively; they may include any device used in the performance of a task. For example, first and second implements 20, 30 may include a shovel, a hammer, an auger, a ripper, or any other task-performing device known in the art. First and second implements 20, 30 may be configured to pivot, rotate, slide, swing, or move relative to the body 14 in any other manner known in the art.

Hydraulic actuators 40 drive the boom 24, the stick 26, and the bucket 28. Similarly, hydraulic actuators 42 drive the pair of arms 34 and the loader bucket 38. The actuators 40, 42 may be hydraulic cylinders each having a head end and a rod end. Directing hydraulic fluid to the head end extends the actuator 40, 42, while directing fluid to the rod end retracts the actuator 40, 42. An operator may use a plurality of levers 44 within the operator station 15 of the machine 10 to command the actuators 40, 42 through a controller 46.

An engine 50, attached to the body 14, is coupled to a transmission 60 in order to provide power for translational movement of the backhoe loader 12, and is also coupled to at least one pump 70 in order to provide power for operation of the backhoe 22 and the loader 32. The engine 50 may be any power source such as, for example, a diesel engine, a gasoline engine, a gaseous fuel driven engine, or any other engine known in the art. It is contemplated that the engine 50 may alternately include another source of power such as a fuel cell, a power storage device, an electric or hydraulic motor, and/or another source of power known in the art. It is also contemplated that the engine 50 may be operatively connected to the transmission 60 and the pump 70 by any suitable manner known in the art, such as, for example, gearing, a countershaft, and/or a belt. The transmission 60 may be a mechanical or electrical variable-speed drive, a gear-type transmission, a hydrostatic transmission, or any other transmission known in the art. A transmission controller 62, illustrated as a lever attached to the body 14 of the machine 10 in the cab 15, operatively shifts the transmission 60 between forward, neutral, and reverse gears.

Although it should be appreciated that there could be only one throttle controller, FIG. 1 illustrates the machine 10 as having two manual throttle controllers 47, 48. A first throttle controller 47, preferably hand operated, is moveably attached to the console on the rear side 16 of the machine body 14. The operator can control the engine speed when the transmission 60 is not engaged by manipulating the hand-operated first throttle controller 47 between various throttle settings. A second throttle controller 48, preferably a foot pedal, is attached to the machine body 14, although it should be appreciated that the second throttle controller 48 could be attached elsewhere within the cab 15 at a point that the operator can reach when operating the loader 32. The second throttle controller 48 allows the operator to control the machine speed when driving the backhoe loader 12 and, at least in part, when operating the loader 32.

As shown in FIG. 1, the first and second throttle controllers 47, 48 and the transmission controller 62 are coupled to the controller 46. The controller 46 may be an electronic control module and may also include one or more microprocessors, a memory, a data storage device, a communications hub, and/or other components known in the art. It is contemplated that the controller 46 may be further configured to receive additional inputs (not shown) indicative of various operating parameters of the machine 10 and or additional components, such as, for example, temperature sensors, positions sensors, and/or any other parameter known in the art. It is also contemplated that the controller 46 may be preprogrammed with parameters and/or constants indicative of and/or relating to the machine 10. It is also contemplated that the controller 46 may receive and deliver signals via one or more communication lines (not shown) as is conventional in the art. It is further contemplated that the received and delivered signals may be any known signal format, such as, for example, a current or a voltage level.

Figure 2:
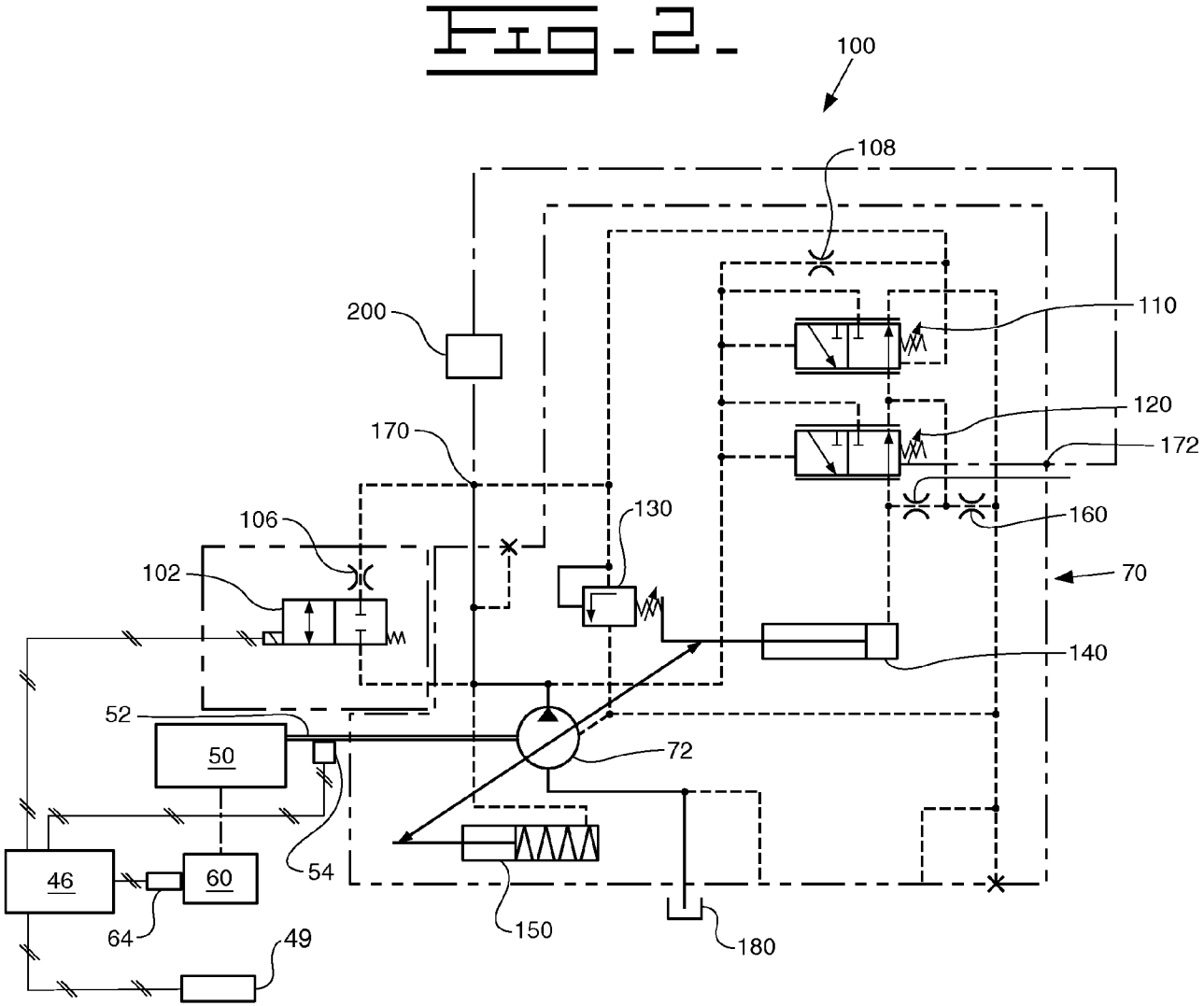
FIG. 2 is a schematic illustration of an exemplary hydraulic system for use with the present disclosure.

As illustrated in FIG. 2, the engine 50 transfers power to both a hydraulic system 100 and the transmission 60. The engine 50 transfers power to the hydraulic system 100 through an engine output shaft 52, with an engine speed sensor 54 measuring the engine speed and communicating that engine speed to the controller 46. The transmission 60 has a transmission status sensor 64 that detects the status of the transmission 60, whether in forward, neutral, or reverse, and which gear, if any, and communicates the transmission status to the controller 46.

The machine 10 may also include a ground speed sensor 49 that may measure the ground speed of the machine 10 and communicate that information to the controller 46. The ground speed sensor 49 may operate by measuring the revolutions made by the wheels to calculate the ground speed. The ground speed sensor 49 may also be used to sense the transmission status, as the ground speed sensor 49 would sense whether the wheels were rotating in a forward or reverse direction, or stopped altogether.

The hydraulic system 100 includes the pump 70, a solenoid valve 102, a tank 180, and the hydraulic load 200, which includes the actuators 40, 42 and the load on the machine 10. The pump 70 includes a hydraulic pump 72, a set point orifice 108, a torque limiter 130, a torque control valve 110, a flow control valve 120, an actuating piston 140, a biasing piston 150, and a plurality of orifices 160. The hydraulic pump 72 is depicted as a unidirectional variable displacement axial piston pump, available from Bosch Rexroth Corporation, although other types of pumps may also be used. The hydraulic pump 72 may be configured to produce a variable output of pressurized fluid and may include a swash plate pump and/or any type of variable displacement pump. The biasing piston 150 is coupled to the swash plate of the hydraulic pump 72 and serves to keep the hydraulic pump 72 at a maximum swash plate angle. The swash plate of the hydraulic pump 72 is also coupled to both the actuating piston 140 and the torque limiter 130. When hydraulic fluid is sent to the actuating piston 140, the actuating piston destrokes the hydraulic pump 72 by reducing the swash plate angle. The output of the hydraulic pump 72 is fluidically connected to the hydraulic load 200. A pilot pressure line from the output of the hydraulic pump 72 is also fluidically connected to the solenoid valve 102, the set point orifice 108, the torque control valve 110, and the torque limiter 130. The input of the hydraulic pump 72 is also hydraulically connected to the tank 180, which serves as a reservoir of fluid.

The solenoid valve 102 is shown as having an electrically actuated two-position spool in FIG. 2, although other types of valves may also be used, such as for example, a proportional directional control valve. The solenoid valve 102 receives an electric signal from the controller 46 to move the spool from one position to another, which adjusts the pump 70 from a first or low torque mode to a second or high torque mode, or from the second torque mode back to the first torque mode. If a proportional directional control valve were used for the solenoid valve 102, the controller 46 would increase the current to the solenoid valve 102 based on a predetermined map of current versus speed, for example. The torque setting of the pump 70 would then increase or decrease, which would in turn create a proportional relationship between torque and speed.

The torque control valve 110 is shown as a proportional directional control valve having a spool. The spool may be a closed-center, spring, centered, operated control valve, but alternately could be a solenoid type, pressure compensated valve, or any like valve. Similarly, the flow control valve 120 is also shown as a proportional directional control valve having a two-position spool. As differential pressure across the torque control valve 110 overcomes the spring, the spool moves and sends pump pressure from the line through torque control valve 110 and into the flow control valve 120. From the flow control valve 120, the pump pressure is sent into the actuating piston 140, destroking the hydraulic pump 72.

The torque limiter 130 is shown as a variable relief valve. The torque limiter limits hydraulic torque demand from the engine because, as mentioned above, the swash plate of the hydraulic pump 72 is coupled to the torque limiter 130. This causes the torque limiter 130 to limit the torque of the hydraulic system 100, with a low displacement at high pump pressure, and a high displacement at low pump pressure. The torque limiter 130 causes a transfer of the control of the hydraulic pump 72 from the flow control valve 120 to the torque control valve 110.

The hydraulic system 100 also includes several orifices, including the gap orifice 106, the set point orifice 108, and a plurality of orifices 160. The gap orifice 106 is positioned downstream of the solenoid valve 102 and hydraulically coupled to the set point orifice 108, the torque control valve 110, and the torque limiter 130. The gap orifice 106 is sized to set the gap or difference between the first torque range and the second torque range. The set point orifice 108 is also hydraulically coupled to the torque control valve 110. The gap of the set point orifice 108 is sized depending on the spring setting of the torque control valve 110. For example, a gap size of 0.8 mm may be selected for a 200 psi spring setting for the torque control valve 110, although other sizes may be used as well. The gap of the set point orifice 108 also determines the low set point of the solenoid valve 102, such that a smaller orifice will result in a lower set point and a larger orifice will result in a larger set point. The plurality of orifices 160 affects the damping and stability of the hydraulic system 100, determining how fast or slow the hydraulic system 100 responds.

Figure 3:
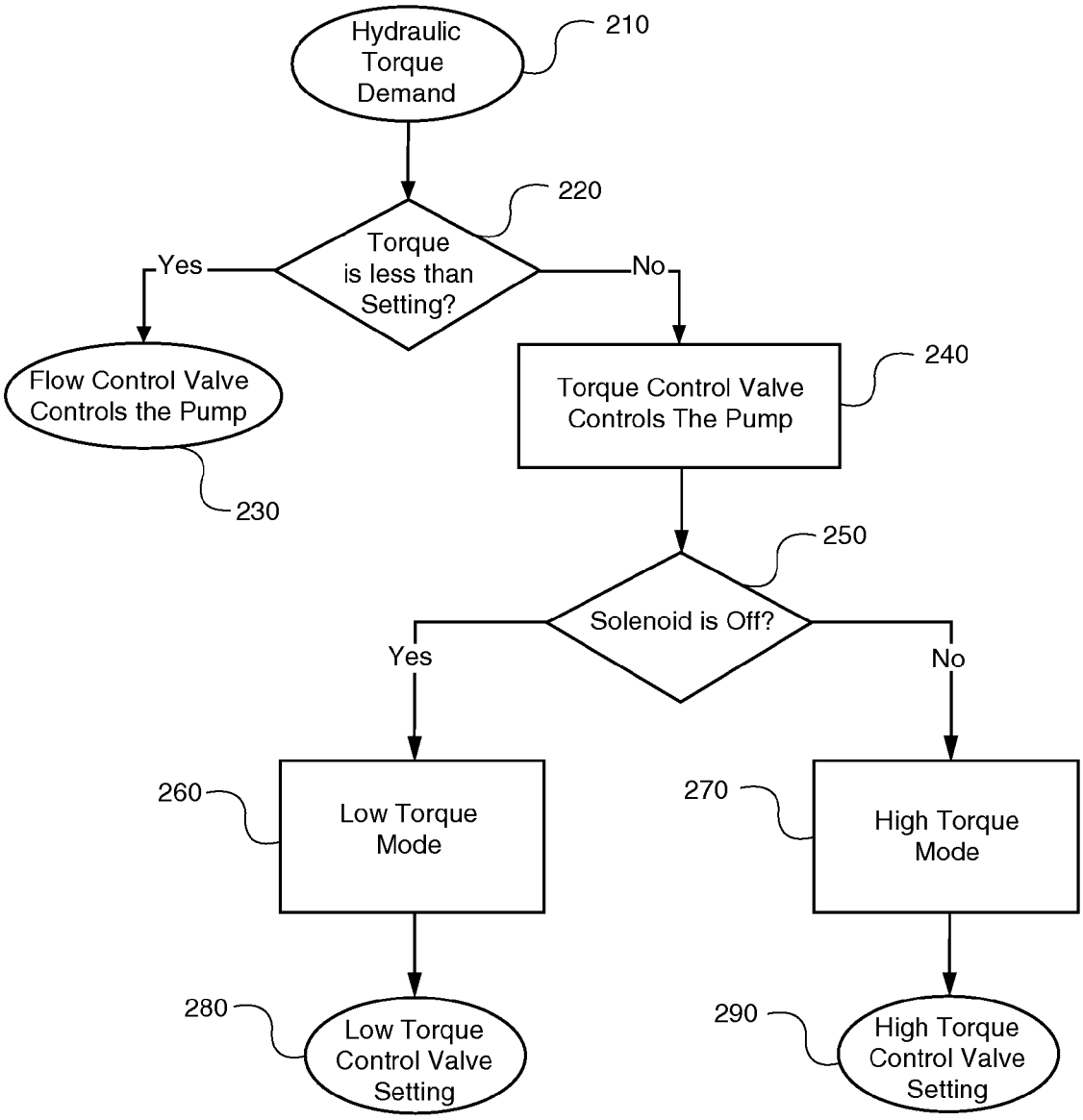
FIG. 3 is a flowchart illustrating an exemplary disclosed method of controlling the solenoid valve actuation of the hydraulic system of FIG. 2.
Figure 4:
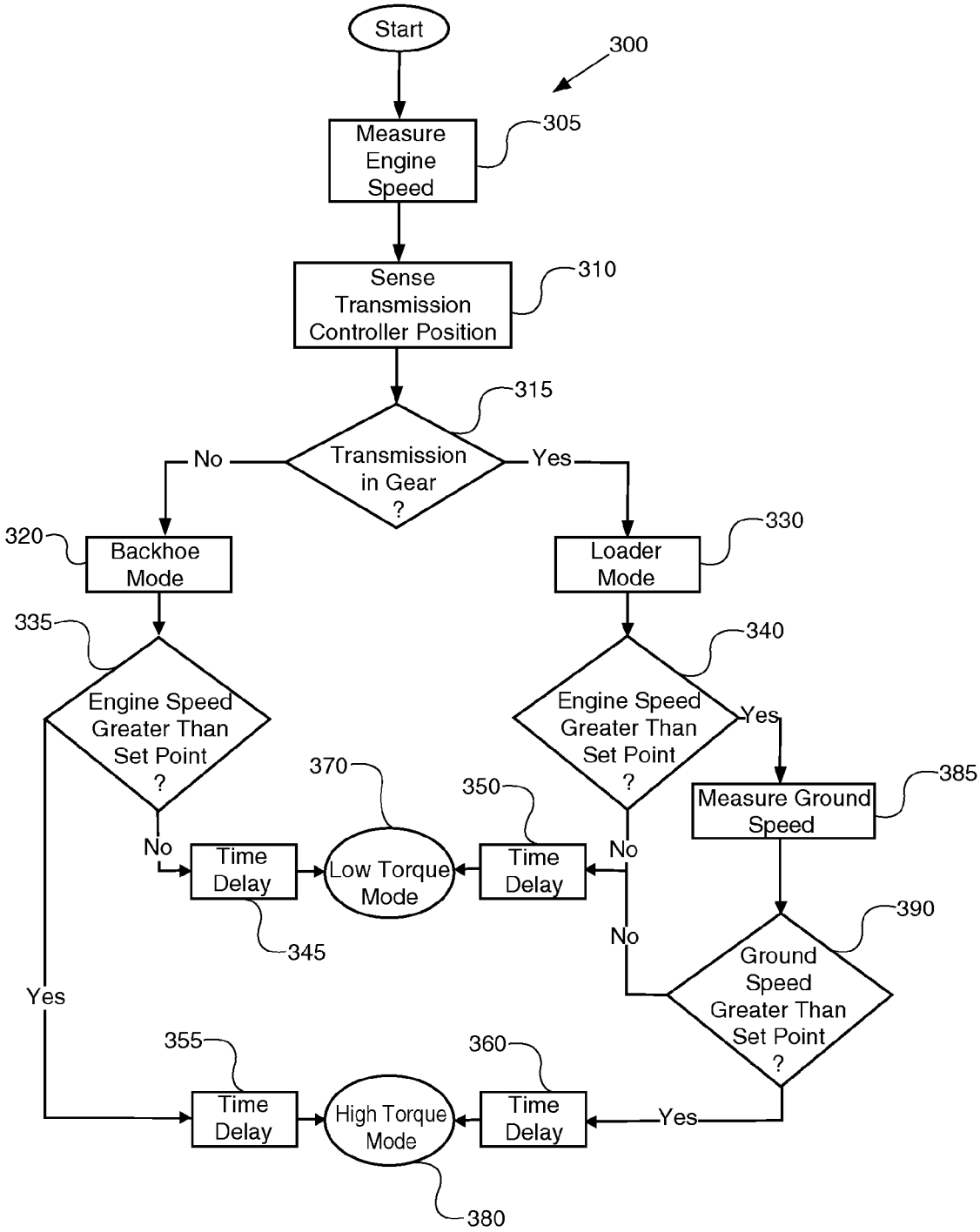
FIG. 4 is a flowchart illustrating an exemplary disclosed method of operating the hydraulic pump of FIG. 2.

FIG. 3 illustrates a flowchart depicting the solenoid valve 102 actuation. FIG. 4 illustrates a flowchart describing a method of automatically controlling the torque mode of the hydraulic pump 72. FIGS. 3 and 4 will be discussed in the following section to further illustrate the disclosed system and its operation.

INDUSTRIAL APPLICABILITY

In operation and as illustrated in the flowchart of FIG. 3, a hydraulic torque demand (Step 210) is provided to the hydraulic system 100. This hydraulic torque demand is represented as the hydraulic load 200 in FIG. 2 and provided through operation of the hydraulic actuators 40, 42 of the machine 10, with hydraulic fluid flowing from an output port 170 in the pump 70 and returning through an input port 172 in the pump 70. Once the hydraulic torque demand is provided, the torque limiter 130 automatically determines whether the hydraulic torque demand is less than the setting of the torque limiter 130 (Step 220). If the hydraulic torque demand is less than the setting, then the flow control valve 120 controls the hydraulic pump 72 (Step 230). There is no hydraulic oil flow through the torque limiter 130 as it is closed and hence no flow through the orifice 108. This causes the pressure to be balanced across the torque control valve 110, which is spring biased. As a result, the torque control valve 110 does not control the hydraulic pump 72. The flow control valve 120 would have pump pressure on one side and load pressure on the other side. This pressure imbalance would bias the flow control valve 120 to a position connecting the actuating piston 140 to the tank 180, upstroking the hydraulic pump 72. The pump 70 would eventually come to an equilibrium position when the hydraulic pump 72 provides enough flow to cause a pressure difference of a predetermined value between the pump and load pressures. In one preferred embodiment, the predetermined value is 22 bar, although other pressures may be used depending on the machine and model specifications.

However, if the hydraulic torque demand is greater than the torque limiter 130 setting, then the torque control valve 110 controls the hydraulic pump 72 (Step 240). When the torque limiter 130 opens, it creates a flow across the orifice 108. As the flow increases, a pressure drop is created across the orifice 108 and the torque control valve 110. When a sufficient pressure drop is generated across the torque control valve 110, the torque control valve 110 shifts and overcomes its biasing spring. This shifting of the torque control valve 110 causes the pump pressure to be connected to the actuating piston 140, which destrokes the hydraulic pump 72. The torque control valve 110 overrides the flow control valve 120.

If the solenoid valve 102 is off (Step 250), the hydraulic system 100 operates in a low torque mode (Step 260) and the torque control valve 110 has a low pressure setting (Step 280). However, if the solenoid valve 102 is actuated, the hydraulic system 100 operates in a high torque mode (Step 270) and the torque control valve has a high pressure setting (Step 290). The pilot pressure from the hydraulic pump 72 is connected through the orifice 106 to the torque control valve 110 by the solenoid valve 102. This pressure increases the setting of the torque control valve 110 and hence increases the pump torque setting from the low pressure setting to the high pressure setting.

As illustrated in the flowchart of FIG. 4, the method of operating the hydraulic pump 300 includes measuring the engine speed (Step 305). As illustrated in FIG. 2, the engine speed sensor 54 measures the engine speed and communicates that engine speed to the controller 46. The transmission status sensor 64 must also sense the position of the transmission controller 62 (Step 310) and communicate the transmission status to the controller 46. The controller determines whether the transmission 60 is in gear (Step 315) based upon the transmission status. If the transmission 60 is in gear (forward or reverse), the machine 10 is in loader mode (Step 330). If the transmission 60 is not in gear (neutral), the machine 10 is in backhoe mode (Step 320). In either the loader mode or backhoe mode, the controller 46 determines whether the engine speed is greater than a set point (Steps 335, 340). If the engine speed is below the set point, the hydraulic system 100 operates in a low torque mode (Step 370) after a first time delay (Step 345), where the solenoid valve 102 is de-energized. For the loader mode, one exemplary engine speed set point is 1600 rpm; however, other set points may also be used. For the backhoe mode, one exemplary engine speed set point is 1200 rpm. As mentioned above, other set points may also be used. In addition, both the loader and backhoe engine speed set points may be made machine and model specific, or may be customized according to a user's preferences or skill level.

While in the backhoe mode, if the engine speed is greater than the set point, a second time delay elapses (Step 355) and the hydraulic system 100 operates in a high torque mode (Step 380). In the high torque mode, the controller 46 actuates the solenoid valve 102, which switches the pump from the first low torque range to the second high torque range.

In the loader mode, an optional step of measuring the ground speed of the machine (Step 385) may be performed if the engine speed is greater than the set point. The controller next determines if the machine ground speed is greater than a predetermined set point (Step 390). If the ground speed is below the set point, the hydraulic system 100 operates in a low torque mode (Step 370) after a time delay (Step 350), where the solenoid valve 102 is de-energized. However, if the ground speed is above the set point, the hydraulic system 100 operates in a high torque mode (Step 380) after a time delay (Step 360). In one preferred embodiment, the set point is 10 miles per hour, although other ground speed set points may be used depending on the machine, model, or application.

The time delays (Steps 345, 350, 355, 360) may vary depending on several conditions, such as whether the machine 10 is in loader or backhoe mode, or whether the hydraulic system 100 is changing from a low torque to a high torque mode or a high torque to a low torque mode. In one exemplary embodiment, the time delays (Steps 345, 355) in backhoe mode are both set to 2 seconds, the time delay (Step 360) in loader mode going from a low torque mode to a high torque mode is set to 1.5 seconds, and the time delay (Step 350) going from a high torque mode to a low torque mode is 0.5 seconds. The addition of the time delay may prevent the hydraulic system from hunting when the engine 50 is operating at an engine speed near the set point and may also smooth the transition between modes. However, one or more of the time delays may be eliminated. It is contemplated that the time delays may also be set to other values, and may also be optimized for a given machine and model specific, or may be customized according to a user's preferences or skill level.

In addition, the engine speed set point at which the machine 10 changes from low torque to high torque modes may differ depending on whether the machine is in loader mode (Step 330) or backhoe mode (Step 320). In one exemplary embodiment, when the machine is in backhoe mode, the engine speed set point is at 1200 rpm. When the machine is in loader mode, the engine speed set point is raised to 1600 rpm. This difference in set point allows engine power to be diverted to the transmission and to accelerate the machine at low speeds while in loader mode. However, once the machine is moving, it does not need as much torque, allowing the hydraulics to accelerate.

In addition, whenever the transmission controller 62 is shifted, such as between forward and reverse, from forward to neutral, or from neutral to reverse, the hydraulic system 100 may automatically switch back to low torque mode, with a timer reset to zero. This may ensure a consistent change to high torque mode and may also provide an operator with transmission power to accelerate the machine.

Several advantages over the prior art may be associated with the hydraulic system 100 of the machine 10. For example, the disclosed system may provide a method for automatically optimizing the performance of a machine, including the engine power, machine speed, sensitivity, and fuel economy. The disclosed system reduces the need for a machine operator to simultaneously monitor multiple variables such as the current pump mode, the engine speed, the transmission status, and the active implement. This need is only amplified when novice operators operate the machine, as they may have difficulty efficiently switching between modes. In addition, the disclosed system allows for an operator to efficiently switch between modes when the machine is moving, for example while operating the loader.

Other aspects, objects and advantages of this invention can be obtained from a study of the drawings, the disclosure, and the appended claims.

What is claimed is:

1. A backhoe loader comprising:

an engine;

an engine speed sensor configured to sense the speed of the engine;

a transmission coupled to the engine;

a transmission status sensor configured to sense the status of the transmission;

a pump coupled to the engine and having a first torque mode and a second torque mode;

an actuator hydraulically coupled to the pump;

a hydraulic implement operably coupled to the actuator and independent of the transmission; and a controller in communication with the engine speed sensor and the transmission status sensor, the controller being configured to:

select one of a backhoe mode and a loader mode based on the transmission status sensor;

switch the pump from the first torque mode to the second torque mode when the engine speed exceeds a first set point and when the controller is in the loader mode; and switch the pump from the first torque mode to the second torque mode when the engine speed exceeds a second set point and when the controller is in the backhoe mode, wherein the second set point is less than the first set point.

2. The machine of claim 1, wherein the pump has a solenoid valve in communication with the controller and configured to switch the pump from the first torque mode to the second torque mode.

3. The machine of claim 1 further comprising:

a ground speed sensor configured to sense the ground speed of the machine and in communication with the controller; and wherein the controller is further configured to switch the pump from the first torque mode to the second torque mode based at least in part on the ground speed.

4. The machine of claim 1, wherein the controller is configured to switch the pump from the first torque mode to the second torque mode after a first time delay.

5. The machine of claim 4, wherein the controller is configured to switch the pump from the second torque mode to the first torque mode after a second time delay, and wherein the first time delay is not equal to the second time delay.

6. A method of controlling a hydraulic implement on a backhoe loader, the backhoe loader having an engine coupled to a pump and a transmission, the pump having a first torque mode and a second torque mode, comprising:

providing an actuator hydraulically coupled to the pump, the hydraulic implement being operably coupled to the actuator and independent of the transmission;

measuring an engine speed;

sensing a transmission status;

communicating the engine speed and transmission status to a controller;

setting the controller to one of a backhoe mode or a loader mode based on the transmission status;

switching the pump from the first torque mode to the second torque mode when the engine speed exceeds a first set point and when the controller is in the loader mode; and switching the pump from the first torque mode to the second torque mode when the engine speed exceeds a second set point and when the controller is in the backhoe mode, wherein the second set point is less than the first set point.

7. The method of claim 6, further comprising waiting for a first time delay to lapse before switching the pump from the first torque mode to the second torque mode.

8. The method of claim 7, further comprising waiting for a second time delay to lapse, wherein the first time delay is not equal to the second time delay, and wherein the controller bases switching the pump from the second torque mode to the first torque mode on the engine speed and the transmission status.

9. The method of claim 6, wherein the pump has a solenoid valve operatively coupled to the controller, wherein the controller actuates the solenoid valve to switch the pump from the first torque mode to the second torque mode.

10. The method of claim 6, further comprising measuring a ground speed of the machine and communicating the ground speed to the controller, wherein the controller further bases switching the pump from the first torque mode to the second torque mode at least in part on the ground speed.

11. The method of claim 10, further comprising waiting for a first time delay to lapse before switching the pump from the first torque mode to the second torque mode when the controller is in the loader mode; and waiting for a second time delay to lapse before switching the pump from the first torque mode to the second torque mode when the controller is in the backhoe mode, and wherein the first time delay is not equal to the second time delay.

12. A method of controlling a hydraulic implement on a backhoe loader, the backhoe loader having an engine coupled to a pump and a transmission, the pump having a first torque mode and a second torque mode, comprising:

providing an actuator hydraulically coupled to the pump, the hydraulic implement being operably coupled to the actuator and independent of the transmission;

sensing a transmission status;

setting a controller to one of a backhoe mode or a loader mode based on the transmission status;

measuring an engine speed;

communicating the engine speed and transmission status to the controller;

operating the controller to automatically switch the pump from the first torque mode to the second torque mode when the engine speed exceeds a first set point and when the controller is in the loader mode; and automatically operating the controller to switch the pump from the first torque mode to the second torque mode when the engine speed exceeds a second set point and when the controller is in the backhoe mode.

13. The method of claim 12, further comprising measuring a ground speed of the machine and communicating the ground speed to the controller, wherein the controller further bases switching the pump from the first torque mode to the second torque mode at least in part on the ground speed when the controller is in the loader mode.

* * * * *